US005430262A

United States Patent [19]

Matsui et al.

[11] Patent Number: 5,430,262

[45] Date of Patent: Jul. 4, 1995

[54] MULTIPLE SWITCH ARRANGEMENT INCLUDING MEMBRANE DOME CONTACTS AND MULTI-DIRECTIONAL TILT ACTUATOR

[75] Inventors: Hiroshi Matsui, Hirakata; Yukihiro Ishihara, Kaizuka; Keiji Kaizaki, Neyagawa, all of Japan

[73] Assignee: Matsushita Electric Industrial Co., Ltd., Osaka, Japan

[21] Appl. No.: 117,806

[22] Filed: Sep. 8, 1993

[30] Foreign Application Priority Data

Sep. 9, 1992 [JP] Japan ..... 4-240532
Oct. 29, 1992 [JP] Japan ..... 4-291089

[51] Int. Cl.[6] ..... H01H 9/00; H01H 13/70; H01H 25/04

[52] U.S. Cl. ..... 200/5 A; 200/6 A; 200/11 R; 200/17 R; 200/18

[58] Field of Search ..... 200/5 R, 5 A, 6 A, 512–517, 200/553, 557, 4, 520, 11 R, 17 R, 18, 339

[56] References Cited

U.S. PATENT DOCUMENTS

| | | | |
|---|---|---|---|
| 4,029,915 | 6/1977 | Ojima | 200/5 A |
| 4,245,137 | 1/1981 | Hirai et al. | 200/4 |
| 4,246,452 | 1/1981 | Chandler | 200/5A |
| 4,256,931 | 3/1981 | Palisek | 200/5 A |
| 4,394,546 | 7/1983 | Harumatsu | 200/5 R |
| 4,401,864 | 8/1983 | Ichikawa | 200/17 R |
| 4,468,542 | 8/1984 | Pounds | 200/5A |
| 4,571,467 | 2/1986 | Sorenson et al. | 200/6 BA |
| 4,590,338 | 5/1986 | Suzuki | 200/5 R |
| 4,611,102 | 9/1986 | Ishida | 200/5 R |
| 4,679,025 | 7/1987 | Ohashi | 338/197 |
| 4,687,200 | 8/1987 | Shirai | 273/148 B |
| 4,861,950 | 8/1989 | Yanai et al. | 200/5 R |
| 4,866,219 | 8/1989 | Riding et al. | 200/4 |
| 4,927,990 | 5/1990 | Aoki et al. | 200/517 |
| 4,947,461 | 8/1990 | Yoshioka et al. | 200/5 R |
| 4,968,862 | 11/1990 | Maeda | 200/5 R |
| 4,992,631 | 2/1991 | Gee | 200/5 A |
| 5,034,572 | 7/1991 | Kouno et al. | 200/5 R |

FOREIGN PATENT DOCUMENTS

| | | | |
|---|---|---|---|
| 3328612 | 2/1985 | Germany | H01H 13/70 |
| 9210286 | 9/1992 | Germany | H01H 25/04 |

*Primary Examiner*—J. R. Scott
*Attorney, Agent, or Firm*—Willian Brinks Hofer Gilson & Lione

[57] ABSTRACT

A multiple switch device comprises a base having at least two switch units and supports with pawls placed on the tips of the pawls, a push button having at least two push members and supports with pawls placed on the tips of the pawls, and a spring for returning the push button to its original position. The base and the push button are assembled together through a coupling between the pawls of the supports of the base and the pawls of the supports of the push button. The push button moves in a seesaw-like motion, the fulcrum of which is derived by the two adjacent supports. The push members and the supports are arranged so that the fulcrum position is situated in the same or inside position of the push members.

12 Claims, 7 Drawing Sheets

MULTIPLE SWITCH ARRANGEMENT INCLUDING MEMBRANE DOME CONTACTS AND MULTI-DIRECTIONAL TILT ACTUATOR

BACKGROUND OF THE INVENTION

1. Field Of The Invention

The present invention relates to a combination push switch device having multiple operational functions for use in the remote controller for audio visual equipment, such as consumer electronics, in the keyboard for office automation equipment, and similar applications.

The term "push switch device" means a multiple switch device including a push-button type actuator, and either a rotary or pivoted actuator used with its associated switch assembly or switch units.

2. Discussion Of Related Art

In recent years as more and more functions are incorporated with audio visual equipment and office automation equipment, there have been used different combination push switch devices wherein a plurality of switch elements are put together on a base.

Specific examples of such combination push switch devices are found in the remote controller of a video cassette recorder for operating the functions of reproducing, recording, forwarding, rewinding, stopping, or similar operations and in the keyboard of a personal computer for shifting a cursor on the display up and down or right and left.

These combination push switches are usually built from a plurality of basic switch parts, which are comprised of pairs of switch elements and push buttons and arranged on specified positions on a base, and a cover plate with a plurality of openings, through which the push buttons project, to protect the rest of the basic switch part assembly. The push buttons are supported by spiral springs for moving up and down and are also provided with flanges having diameters larger than those of the openings made on the cover plate to prevent the push buttons from jumping out upward.

As smaller sizes and reduced prices have been required of many kinds of electronic equipment recently, strong requirements for smaller dimensions and lower costs have been put forth with the combinations push switch devices used in such equipment.

However, because of the structure of the prior art combination push switch devices, which include numerous individual basic switch parts, a high density layout of those basic switch parts is not possible, resulting in imposing some limitations on the size reduction of such devices. In addition, since many component parts are used, the assembly of the combination push switch devices tends to be complex and the steps thereof also tend to be numerous. As a result, the assembly cost of such prior art devices is likely to be high.

The prior art discussed above does not suggest the advantage of having a combination push switch device comprising a single push button with at least two push members which can independently operate at least two switch elements.

SUMMARY OF THE INVENTION

One embodiment of the invention is directed to a combination push switch device which comprises:

(a) a base which comprises at least two switch elements and a linkage means placed in at least two positions on the base;

(b) a push button having push members at each respective position opposite to each of the switch elements and a linkage means at each respective position opposite to each of the linkage means on the base; and (c) a return means which forces the push button to return to the original position thereof when a depress force is released from the push button.

The base and the push button are coupled (assembled) through a coupling between the linkage means of the base and the linkage means of the push button so as to allow the push button to move vertically.

A second embodiment of the invention is directed to the combination push switch device described above which additionally comprises a central, second push button, smaller in size than the push button described above. The central push button is inserted into an opening provided substantially in the central portion of the push button. The central button is movable in the vertical direction independently of the push button. A separate switch element is arranged on the base at a position opposite and corresponding to the central push button to provide an additional switch element independent of the switch elements operated by the push button.

Each of the switch elements comprises a fixed contact formed on the upper surface of the base, a movable contact arranged on the fixed contact, and an adhesive insulating film for maintaining the movable contact on the fixed contact. The movable contact is preferably dome-shaped.

An additional embodiment of the invention is directed to a combination push switch device which incorporates a rotational angle detecting function into the push switch device described above. The combination push switch device of this embodiment comprises:

(a) a base which includes at least two switch elements and linkage means placed in at least two positions on the base;

(b) a push button having push members at each respective position opposite to each of the switch elements and linkage means at each respective position opposite to each of the linkage means of the base;

(c) a return means which forces the push button to return to the original position thereof when a depress force is released from the push button;

(d) a ring-like knob arranged outside the outer circumference of the push button, the ring-like knob provided with a knob-placed linkage means;

(e) a linkage means for the knob arranged on the base at positions opposite to the knob-placed linkage means;

(f) a rotational angle detecting means for detecting the rotational angle of the ring-like knob; and (g) a rotational return means for returning the ring-like knob to the original position thereof upon release of the rotational operation.

In this embodiment, the base and the push button are assembled together through a coupling between the linkage means of the base and the linkage means of the push button to allow for a vertical movement of the push button. The base and the ring-like knob are assembled together through a coupling between the linkage means for the knob on the base and the knob-placed linkage means on the ring-like knob to allow a rotational movement of the ring-like knob.

The rotational angle detecting means comprises at least one slide contact formed on the bottom surface of the ring-like knob and circular arc-shaped contacts formed on the base at positions opposite to the slide contacts.

The combination push switch device of this invention provides important advantages. With the combination push switch device of this invention, one push button can operate a plurality of switch elements independently due to the seesaw-like motion of the push button. Additionally, the miniaturization of the device and a reduction in the number of components used in its construction can be achieved.

The seesaw-like motion of the push button is facilitated by the couplings formed by the linkage means of the base and the linkage means of the push button. The couplings serve as fulcra at least two places for a stabilized motion. Thus, even when one of the switch elements is turned on, it is possible to have the other switch element kept open, i.e., turned off, thereby preventing erroneous functioning of the switch device. Furthermore, the extremely compact construction of the switch elements results in a reduction of the thickness of the switch elements and contributes to a thin construction of the entire combination push switch device.

Additionally, since multiple switch elements can be formed at one time on the base, the assembly of the combination push switch device is substantially simplified.

Further, by having each linkage means of both the base and the push button constructed from a support which is provided with a slip preventive means, such as a pawl, for example, and by having the supports of the linkage means either of the base or the push button formed of an elastic material, the linkage means of the base and of the push button can be coupled with each other simply by pressing the push button down towards the base, which simplifies assembly of the device.

Additionally, by having the linkage means placed in appropriate positions so that the fulcra of the seesaw motion are located at the same positions as the push member or inside thereof, depressing i.e., activating one switch element does not cause erroneous operation of the other switch elements even if the gaps between the switch elements and the push members are narrowed. Accordingly, the thickness of the whole combination push switch device can be further reduced.

Furthermore, since there is no linkage means in the central portion of the push button, an opening can be made therein and an individual switch element can be placed in the central portion of the push button as discussed above. As a result, the function of the combination push switch device can be expanded. Furthermore the provision of the rotational angle detecting means in one of the embodiments described above makes it possible to provide a combination push switch device of a simple and thin structure and expanded multiple functions.

BRIEF DESCRIPTION OF THE DRAWINGS

FIG. 1 is a perspective view of the combination push switch device.

FIG. 2 is a top plan view of a base on which switch elements have been formed.

FIG. 3 is a cross-sectional view of the combination push switch device cut along the line 81—81, as shown in FIG. 2.

FIG. 4 is a cross-sectional view of the push switch device cut along the line 82—82.

FIG. 5 is an enlarged cross-sectional view of switch elements.

FIG. 6 is a cross-sectional view of the push switch device cut along the line 82—82, while one of the switch elements is in operation i.e., activated.

FIG. 7 is a cross-sectional view of the push switch device cut along the line 81—81, while one of the switch elements is in operation i.e., activated.

FIG. 9 is a perspective view of the combination push switch device.

FIG. 10 is a cross-sectional view of the push switch device of FIG. 9.

FIG. 11 is a cross-sectional view of the push switch device.

FIG. 12 is a top plan view of the push switch device.

FIG. 13 is a top plan view of a contacts board or contact sheet.

FIG. 14 is a top plan view showing how the contacts board is assembled with a base.

FIG. 15 is a top plan view showing how a ring-like knob is mounted on the base.

FIG. 16 is an enlarged cross-sectional view of a switch element.

DESCRIPTION OF THE PREFERRED EMBODIMENTS

Figure 1:
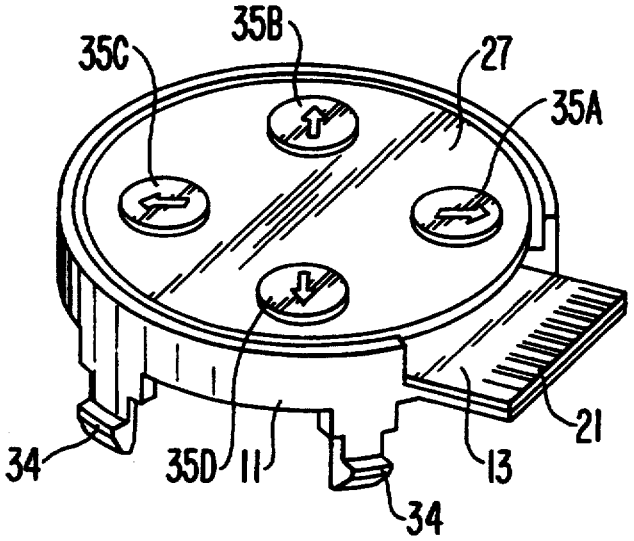
FIGS. 1 through FIG. 7 relate to a combination push switch device described as a first exemplary embodiment Embodiment 1 of the present invention.

The preferred embodiments of the invention will now be described in conjunction with the illustration thereof in the drawings.

According to a first embodiment of the invention, illustrated in FIGS. 1-7, a combination push switch device that can be used, for example, for shifting a cursor of a personal computer will be described. As shown in FIG. 1, the combination push switch device of this embodiment comprises a contact sheet 13 made of a heat resistant resin film with four switch elements formed on its surface. The contact sheet is supported by a base 11. The base 11 is produced by molding an insulating resin. Over the base 11 there is placed a push button 27 having four push positions 35A, 35B, 35C and 35D.

An element 21 is a terminal block of the contact sheet 13 and elements 34 are elastic supports for mounting the combination push switch device to equipment.

The combination push switch device of this embodiment will be described in detail by referring to FIG. 2 through FIG. 5.

Fixed contacts 12A-12D are printed on the contact sheet 13 at respective positions which are located on the axes 82 and 84 at an equal distance from the origin where the two rectangular coordinate axes 82 and 84 cross each other i.e., (the point of intersection of the axes 82 and 84).

Supports 15A, 15B, 15C and 15D, having pawls 14A, 14B, 14C and 14D placed on the tips of the supports to prevent slippage, are integrally molded with the base 11 at respective positions which are located on axes 83 and 85 at an equal distance from the origin of the 83–85 rectangular coordinate axes (the point of intersection of the axes 83 and 85). The 83–85 rectangular coordinate axes are rotated from the 82–84 coordinate axes by 45 degrees.

Elastic dome-shaped movable contacts 16A, 16B, 16C and 16D are fixed over the fixed contacts 12A–12D by means of adhesive insulating films 17A, 17B, 17C and 17D, respectively, thereby creating four switch elements 18A, 18B, 18C and 18D.

Figure 5:
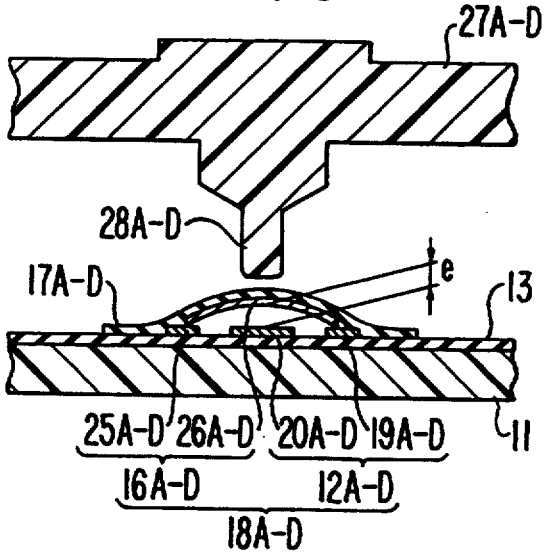

Details of these switch elements 18A–18D will be explained with the help of FIG. 2 and FIG. 5.

The fixed contacts 12A–12D comprise, respectively, C-shaped ring-like contacts 19A, 19B, 19C and 19D located on the outer circumference, small circular contacts 20A, 20B, 20C and 20D located in the center, and leads 22A, 22B, 22C and 22D and leads 23A, 23B, 23C and 23D which make connection between the contacts and the terminals. Insulating paint layers 24A, 24B, 24C and 24D are applied over the places where the C-shaped ring-like contacts 19A–19D are cut out and the leads 23A–23D pass.

Figure 2:
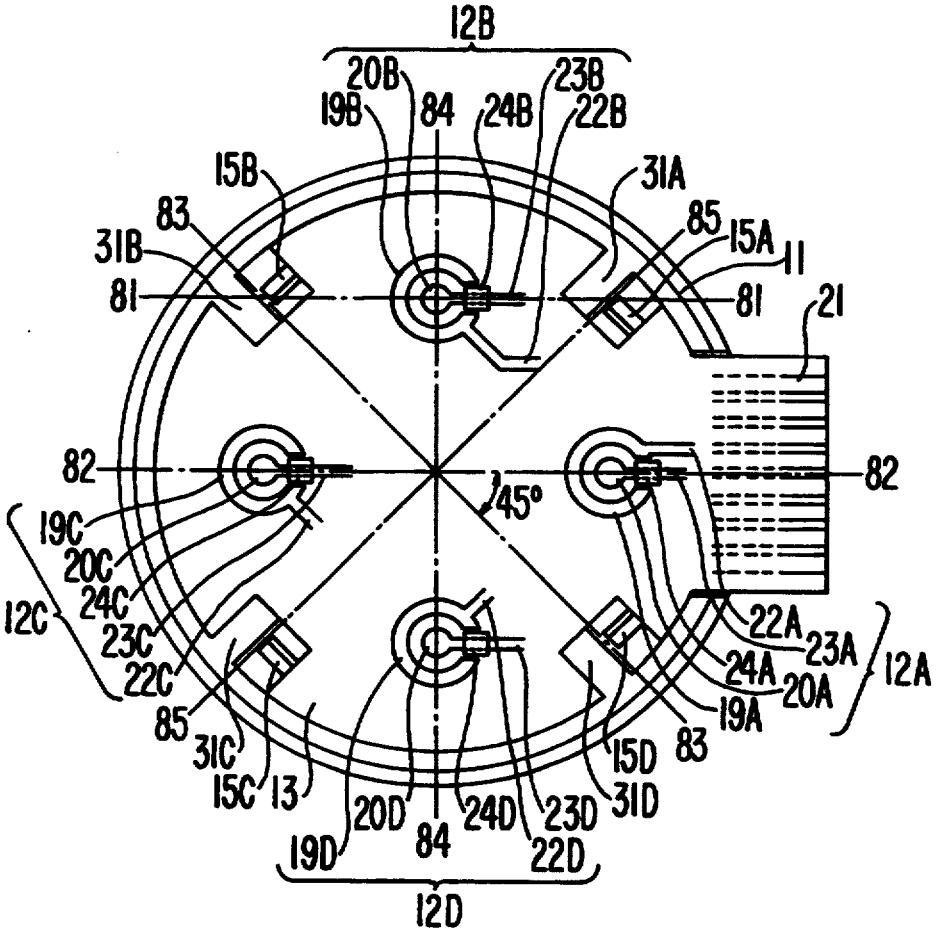
Figure 3:
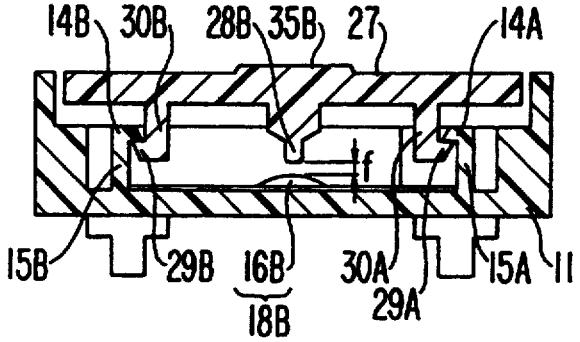
Figure 4:
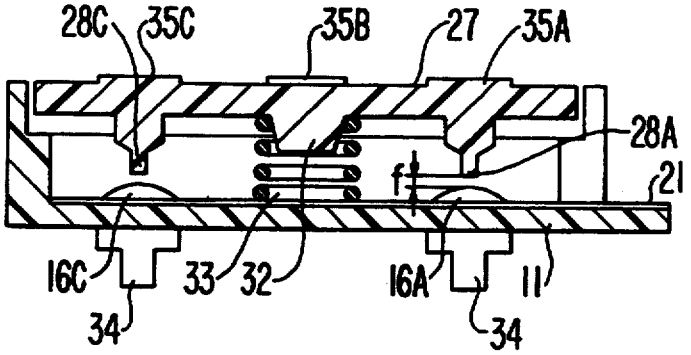

Although the leads 22A–22D and the leads 23A–23D are connected to each terminal of the terminal block 21, the connection is not illustrated in FIG. 2.

The movable contacts 16A–16D placed over the fixed contacts 12A–12D are aligned in their positions so that their peripheries 25A–25D may come into contact with the C-shaped ring-like contacts 19A–19D. The movable contacts are fixed on the base 11 at each respective periphery by means of adhesive insulating films 17A–17D covering the entire structure of each of the movable contacts 16A–16D. At this time, the curved central portions 26A–26D of the movable contacts 16A–16D keep a fixed gap e e.i.e., snap back stroke from the small circular contacts 20A–20D. The leads 23A–23D and the peripheries 25A–25D, of the movable contacts 16A–16D, superimposed over the leads 23A–23D, are insulated from each other by the insulating paint layers 24A–24D.

The push button 27 which actuates i.e., activates, or releases the switch elements 18A–18D is provided with push members 28A, 28B, 28C and 28D on its bottom surface at the places opposite to the respective switch elements.

On each of the radial lines situated just between any pairs of the push members 28A–28D on the bottom surface of the push button 27 are respectively formed rods 30A, 30B, 30C and 30D which are provided with pawls 29A, 29B, 29C and 29D to prevent slippage on the tips of the rods on the outside surface thereof. These rods 30A–30D and pawls 29A–29D are located so that they extend inside of the supports 15A–15D and engage i.e., mesh with the pawls 14A–14D of the supports 15A–15D erected on the base 11. Accordingly, the push button 27 can be supported in such a way that it is movable vertically.

Due to the elasticity of the supports 15A–15D which are formed of an elastic material, the coupling between the rods 30A–30D and the supports 15A–15D takes place by depressing the former onto the latter.

Also, as shown in FIG. 2, the rods 30A–30D are restricted in their rotational motion by stopper extrusions 31A, 31B, 31C and 31D formed next to the supports 15A–15D. The stopper extrusions 31–31D therefore provide an additional means of immobilizing the position of the push button 27 from rotating.

To ensure the operation of the switch elements 18A–18D, there has to be provided a gap f (FIG. 3) between the tips of the push members 28A–28D and the movable contacts 16A–16D. There also has to be maintained a coupling , i.e., an engagement, between the pawls 29A–29D of the rods 30A–30D and the pawls 14A–14D of the supports 15A–15D by forcing the push button 27 away from the base 11 under the normal operational position. For this purpose, a spiral spring 33 (FIG. 4) is placed between the base 11 and the push button 27 at a position defined by an extrusion 32 formed in the central portion of the push button 27.

Further, the elastic supports 34 having catches are used for mounting this combination push switch device on a printed wiring board or similar portion of equipment, and the terminal block 21 of the contact sheet 13 is used for connecting the combination push switch device with the circuit of the equipment by means of a connector or a functionally similar element.

The operation of the combination push switch device of this embodiment will now be explained.

Figure 6:
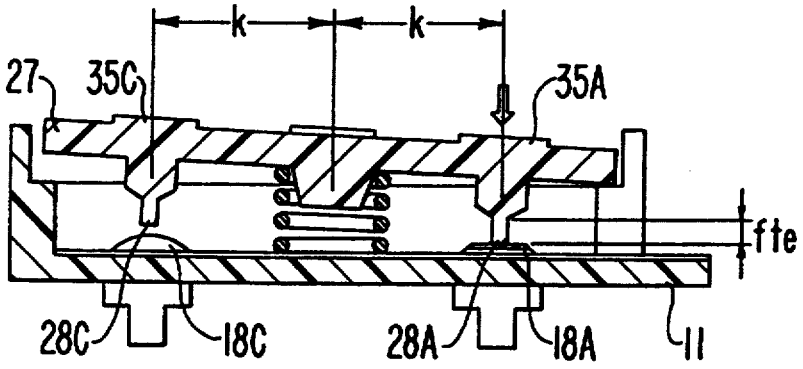
Figure 7:
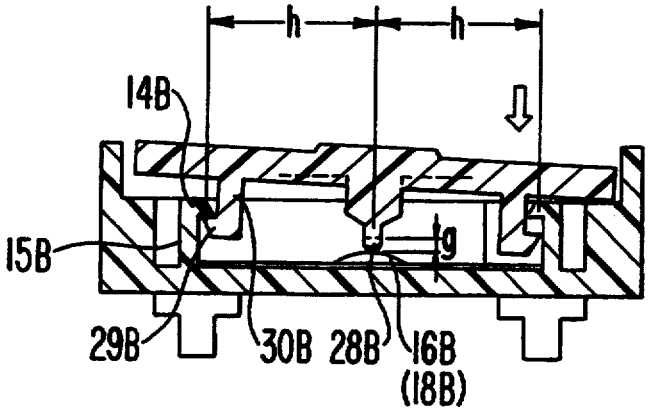

With reference to FIG. 6, assume, for example, that it is desired to operate the switch element 18A.

The specified push position 35A of the push button 27 corresponding to the switch element 18A is depressed and the push button 27 is tilted, with the respective coupling points between the pawls 14B and 14C of the supports 15B and 15C and the pawls 29B and 29C of the rods 30B and 30C serving as fulcra in a seesaw motion.

After the push member 28A located under the push position 35A is moved downward the distance of the gap f and further the central portion 26A of the movable contact 16A is moved downward the distance of the snap back stroke e, the small circular contact 20A of the fixed contact 12A will come into contact with the elastic dome-shaped movable contact 16A.

Upon removal of the depressing force from the push position 35A, the push button 27 returns to its original position due to the force of the spiral spring 33. At the same time, the movable contact 16A will also return to its original state as shown in FIG. 5 due to its own elastic force.

In order for the push members 28B and 28D of the push button 27 not to depress the respective corresponding movable contacts 16B and 16D of the switch elements 18B and 18D when the push button 27 is tilted as in FIG. 6, the downward travel distance g (FIG. 7) of the push members 28B and 28D should be less than the aforementioned gap distance f between the tips of the push members 28B and 28D and the respective movable contacts 16B and 16D.

When the distance between each of the switch elements 18A and 18C (FIG. 6) and the center of the push button 27 is k, and the distance between the fulcra and the center with the tilted push button is h, the downward travel distance g of the push member 28B will be expressed by the equation (1) below:

$$g=(e+f)\cdot h/(h+k)\leqq f \quad (1)$$

In this case, the fulcrum (also referred to herein as the apparent fulcrum is at the point where the line connecting the coupling points of the supports 15B and 30B and those of the supports 15C and 30C crosses the 82 axis.

From the equation (1), the gap distance f can be derived as in the equation (2) below:

$$f\geqq e\cdot h/k \quad (2)$$

In the present embodiment, h is made equal to k ($h=k$) and f becomes equal to or larger than e ($f \geqq e$).

In other words, the gap distance f between each of the switch elements 18A–18D and each of the corresponding push members 28A–28D should be equal to or larger than the return back stroke e e.g., the actuation stroke of the switch element, of the movable contacts 16A–16D. Therefore, when a switch element having a short actuation stroke e, such as the above mentioned switch element is used, the thickness of the combination push switch device becomes small.

Additionally, in case of $h=k$ i.e., $h/k=1$, the seesaw motion of the push button is very smooth and the extremely stabilized operation of it is achieved. In this embodiment the apparent fulcra of the seesaw motion are at the same positions as the switch elements 18A–18D and the respective push members 28A–28D. It will be understood by those skilled in the art that the term "the same positions," means that the apparent fulcra are placed in substantially the same positions on the 82—82 and 84—84 axes as the switch elements and the push members. However, minor deviations from the placement of the apparent fulcra in precisely the same positions, as the switch elements and the push members, are possible. Such deviations will not alter operability of this invention, and are fully within the scope of the invention.

As a result of investigating other embodiments similar to the present embodiment, a ratio of h/k being in the range of 0.8 to 1.4 i.e., $0.8 \leqq h/k \leqq 1.4$, is preferable in stability of the push button operation.

Also, as is clear from the equation (2), a smaller value of h, e.g., as the coupling points become closer to the center of the push button 27, will result in the smaller gap distance f, contributing to making the combination push switch device smaller in thickness.

In an alternative embodiment, the linkage means of the base and of the push button are positioned so that $h \leqq k$, where h and k are as defined above. In this embodiment when h is equal to or smaller than k, i.e., $h \leqq k$, e.g. , the supports 15A–15D and the rods 30A–30D are arranged so as to have the apparent fulcra of the seesaw motion on the 82 and 84 axis situated in the same positions as or inside the switch elements 18A–18D and the push members 28A–28D, it will become possible to realize a combination push switch device of smaller thickness.

As a preferred exemplary embodiment of the means to couple the push button 27 with the base 11, an example wherein supports 15A–15D having pawls 14A–14D on the tips thereof are coupled with rods 30A–30D having pawls 29A–29D on the tips thereof, respectively, has been illustrated. However, other means of coupling can also be employed. For instance, each of the tips of the rods 30A–30D as used in this embodiment can be U-shaped and the pawls 14A–14D, having a suitable complementary shape, such as a hook-shape or a U-shape of the supports 15A–15D can be hung on the U-shaped tips of the rods 30A–30D, respectively, to complete the coupling between the rods 30A–30D and the supports 15A–15D.

Figure 8:
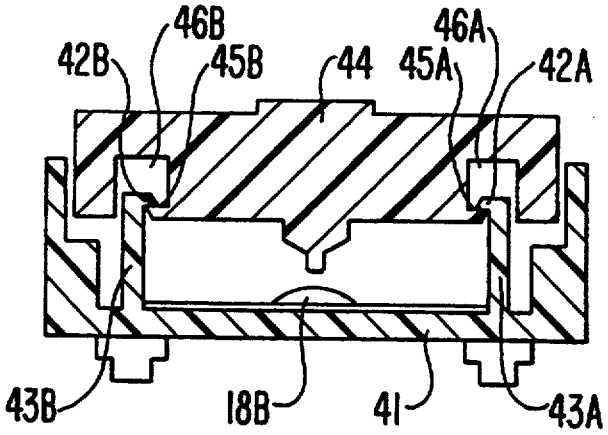
FIG. 8 is a cross-sectional view of a combination push switch device which is a modification of the push switch device of the first embodiment.

Alternatively, as shown in FIG. 8, four supports 43A–43D having pawls 42A–42D on the tips thereof, respectively, are formed on a base 41 in the same way as the foregoing embodiment, and four holes 46A–46D having projections 45A–45B therein, respectively, are formed in a push button 44. In this embodiment, coupling of the base 41 and the push button 44 can be achieved by having the supports 43A–43D inserted in the holes 46A–46D and the pawls 42A–42D coupled with the projections 45A–45D, respectively. In yet another alternative embodiment, not illustrated, the coupling between a base and a push button can be achieved by having four holes each, with a projection, formed in the base and four rods, each with a pawl, formed on the push button.

Figure 9:
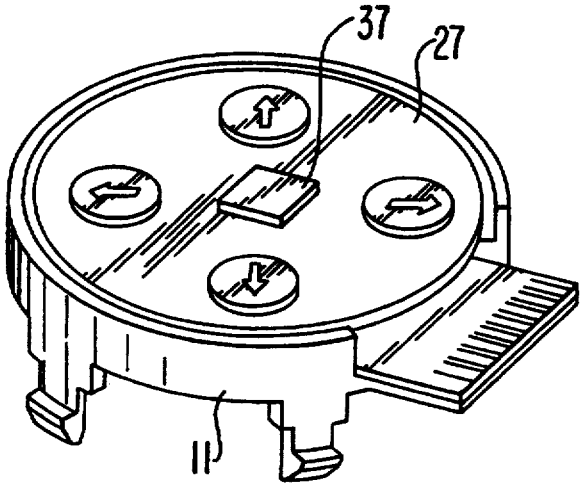
FIG. 9 and FIG. 10 relate to a combination push switch device described as a second exemplary embodiment, Embodiment 2, of the present invention.
Figure 10:
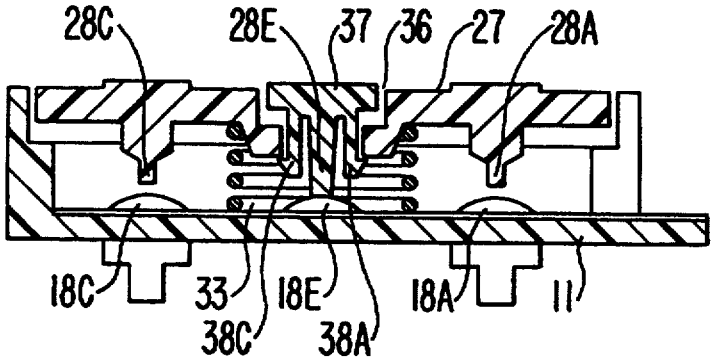
Figure 11:
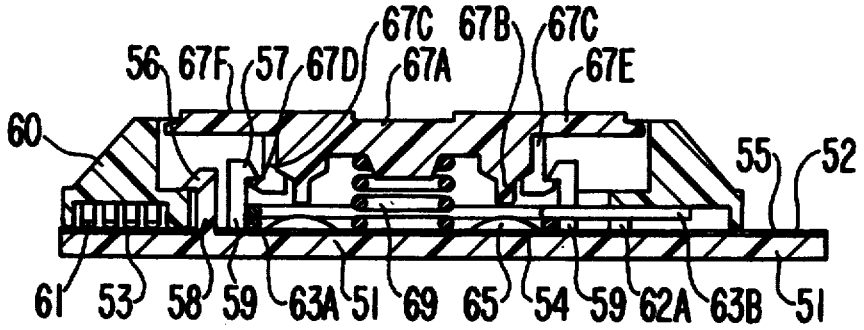
FIG. 11 through FIG. 16 relate to a combination push switch device described as a third exemplary embodiment, Embodiment 3, of the present invention.
Figure 12:
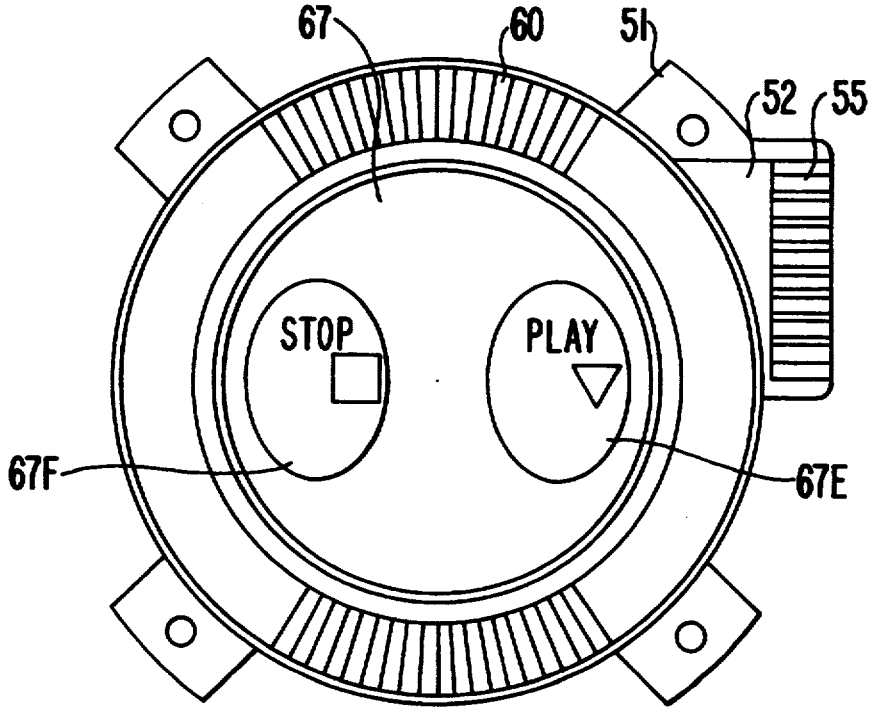

A second embodiment of the invention is illustrated in FIG. 9 and FIG. 10 which show a combination push switch device, which is a modified version of the combination push switch device of the first embodiment discussed above. This combination push switch device has a structure which additionally comprises a push button 27 having in its central portion an opening 36 with a projected step formed inside thereof, a second push button 37 having a push member 28E to be inserted in the hole 36, and a switch element 18E formed on the base 11 at a position opposite to the push member 28E.

The second push button 37 is provided with four rods 38A–38D, with the rods 38B and 38D are not shown in FIG. 10, each having a pawl on the tip thereof. The second push button 37 is movable downwards independently from the push button 27, but is prevented from moving upwards beyond the position where the tip of the push member 28E is on a level with the tips of the other four push members of the push button 27.

Therefore, the switch element 18E can be operated separately from the other switch elements 18A–18D by depressing the push button 37. Additionally, the switch element 18E is not affected by the operation of the push button 27.

It will be understood by those skilled in the art that the switch elements 18A–18D of this second embodiment are constructed and operated in substantially the same manner as the switch elements 18A–18D of the first embodiment of the invention illustrated in FIGS. 1–8, and discussed above. Similarly, the construction and operation of the combination push switch device of this second embodiment is substantially the same as those of the first embodiment, except for the particular differences illustrated and discussed herein.

A third embodiment of the invention is shown with reference to FIG. 11 through FIG. 15, which illustrate a combination push switch device which comprises an encoding function. Such a device can be used in various applications, for example, in a remote controller for video cassette recorders.

An element 51 is a resin molded base, on which a contact sheet 52 formed of a temperature resistant resin film is laminated. On the contact sheet 52 are formed, for example by printing and baking, a circular arc-shaped fixed contact 53 (FIG. 13) for a rotational encoder on the outer circumference, two fixed contacts 54 for switch elements near the central portion, and a terminal block 55 for connection with outside in the end portion.

Five elastic supports 58, each having a pawl 56 on its tip to prevent slipping of the elastic supports 58, and four elastic supports 59, each having a pawl 57 on its tip to prevent slipping of the elastic supports 59, are formed by molding together with the base 51 at positions equally spaced along a circular arc line between said circular arc-shaped fixed contacts 53 and said fixed contacts 54 for switch elements.

An element 60 is a resin molded ring-like knob, which is held by the elastic supports 58 formed on the base 51 in such a way that it can be rotated.

Also, under the bottom surface of the knob 60 are held a slide contact 61, which is formed of a thin metal plate and which contacts the circular arc-shaped fixed contacts 53; and, therefore formed two extruded steps 62A and 62B for clamping down ends 63B of a spiral spring 63.

The main coiling portion 63A of the spiral spring 63 is squeezed into inside the circumference laid out by the elastic supports 59 erected on the base 51 and the ends 63B of the spiral spring 63 are clamped down on the sides 64A and 64B of the elastic supports 59 and on the two extruded steps 62A and 62B of the ring-like knob 60.

Figure 16:
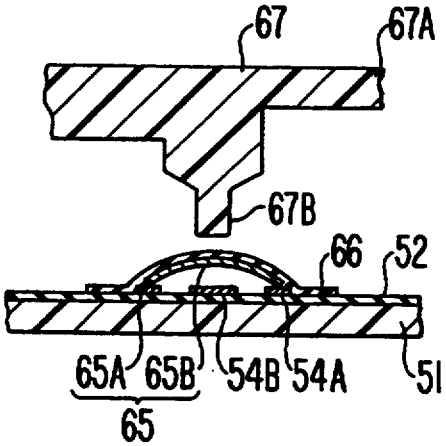

An element 65 is an elastic dome-shaped movable contact for a switch element. One such movable contact is mounted over each respective fixed contact 54 by an adhesive insulating film 66 (FIG. 16).

Figure 13:
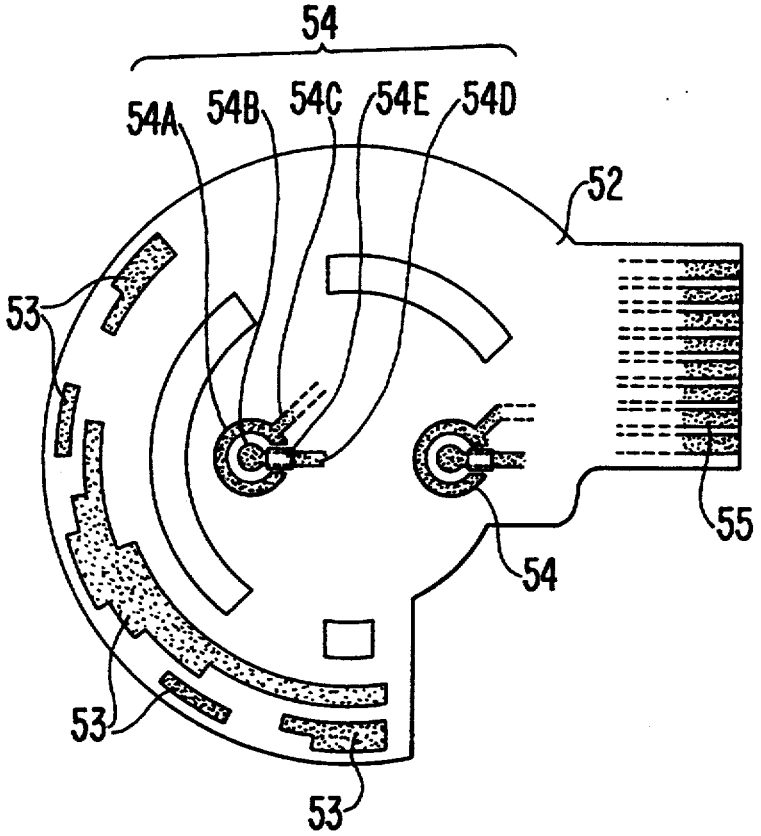
Figure 14:
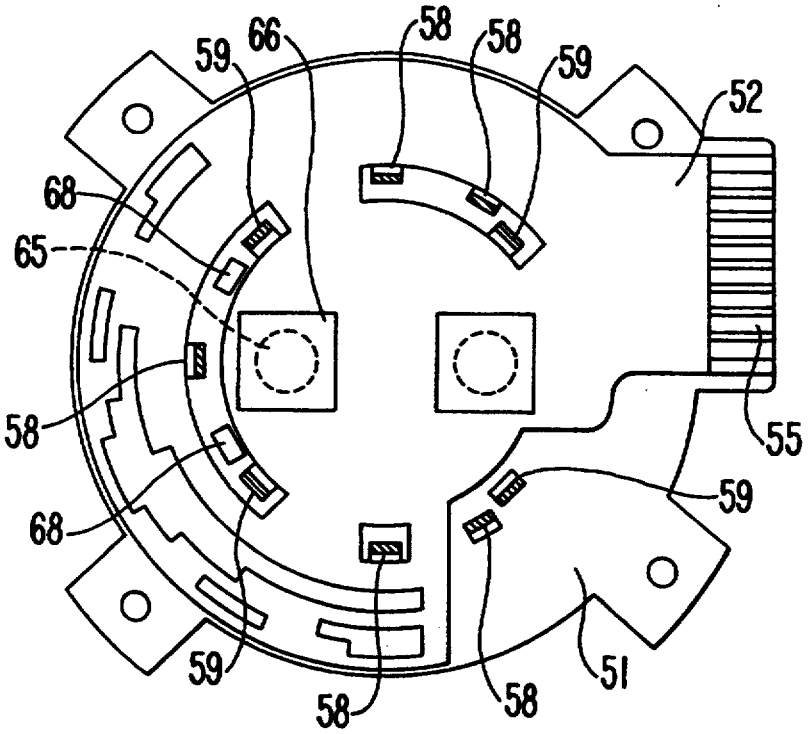
Figure 15:
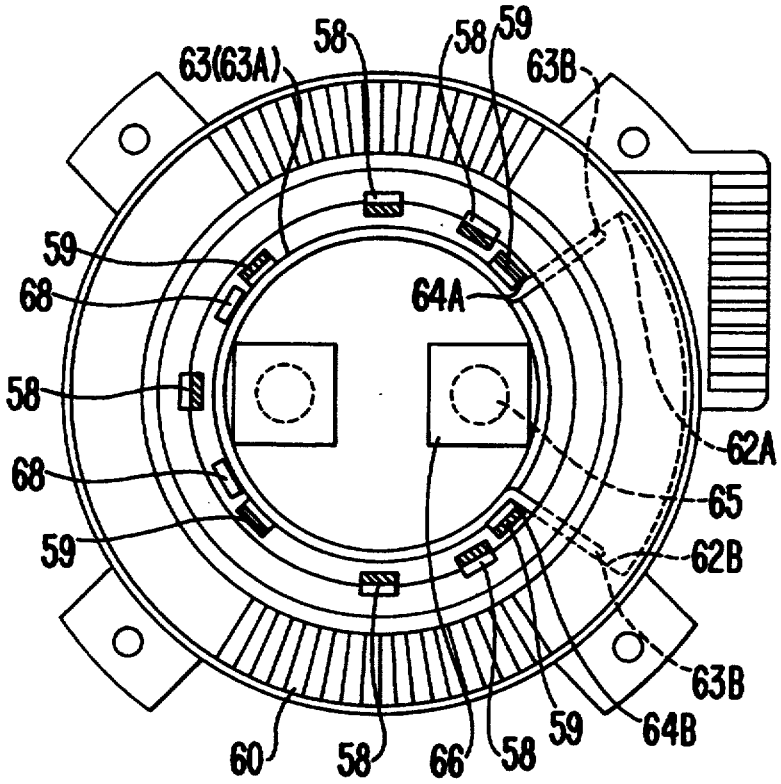

Details of the switch element formed, as in the first embodiment of a fixed contact and a movable contact will be described by referring to FIG. 13 and FIG. 16.

Each respective fixed contact 54 is comprised of a C-shaped ring-like contact 54A located on an outer circumference, a smaller circular contact 54B located in the central portion, and leads 54C and 54D which connect the respective contacts to a terminal block 55.

An insulating paint layer 54E is applied by printing over the area where the C-shaped ring-like contact 54A is cut out and the lead 54D from the smaller circular contact 54B passes.

The position of the movable contact 65 to be mounted over the fixed contact 54 is determined so as to have its outer periphery 65A superimposed exactly on and contacted with the C-shaped ring-like contact and the entire movable contact 65 is covered by an adhesive insulating film 66 to have its periphery fixed onto the base 51.

At this time, the curved central portion 65B of the movable contact 65 keeps a fixed gap from the small circular contact 54B.

The lead 54D and the periphery 65A of the movable contact 65 superimposed over the lead 54D are insulated from each other by the insulating paint layer 54E.

An element 67 is a push button for actuating the switch element formed of the fixed contact 54 and the movable contact 65. The push button 67 is comprised of an upper circular flat member 67A, push member 67B extending downwards to the respective movable contacts 65 and rods 67C with pawls for holding the push button 67 in a specified position.

The rods 67C are formed at the places opposite to the respective elastic supports 59 and arranged on a semicircle which is a little smaller than the circle inscribed with the elastic supports 59 laid out on the base 51 along a circular arc (C-shaped).

The pawls 67D on the tips of the rods 67C are coupled with the corresponding pawls 57, which are formed on the tips of the elastic supports 59 to prevent the pawls 57 from slipping off, with a snapping action due to the elasticity of the elastic supports 59 by just depressing the push button 67.

Two rods out of the four rods 67C are restricted in the rotational motion thereof by projections for rotation stoppage 68 (FIG. 15), which are formed on the base 51 at positions located side by side with the elastic supports 58 and 59, thereby preventing rotation of the push button 67.

To ensure the operation of the switch elements, a gap between the tips of the push members 67B and the movable contacts 65 is created. To maintain a coupling between the pawls 67D of the rods 67C and the pawls 57 of the elastic supports 59, a spring coil 69 of a relatively small diameter is inserted in the central portion of the push button 67.

The operation of the combination push switch device of this embodiment will now be explained.

For purposes of illustration and exemplification, an example where the push button 67 is depressed for selecting a mode of operation of a cassette tape recorder will be described.

When a flat area 67E surrounded by an ellipse on the push button 67 (FIG. 12) is depressed, the push member 67B located on the bottom surface of the push button 67 is moved downwards. Then, the tip of the push member 67B depresses the corresponding movable contact 65 causing its central portion 65B to be pushed down and come into contact with a small circular contact 54B. This causes an electrical contact between the C-shaped ring-like contact 54A and the small circular contact 54B through the movable contact 65.

As a result, an electrical signal is passed to the terminal block 55 through the specified leads 54B and 54C.

At this time, the spiral spring 69 is a little relaxed and two of the pawls 67D located near the depressed flat portion 67E surrounded by an ellipse are detached from the pawls 57 of the elastic supports 59.

When the depress force imposed on the push button 67 is removed, the push button 67 returns to its original position due to the elastic force of the spiral spring 69, and also the movable contact 65 is restored to its original dome-shape as shown in FIG. 16 because of its own elasticity.

Next, there will be described the use of the combination push switch device of this embodiment to perform an encoding function, namely the "shuttle" function, whereby the speed of "Replay" is varied in a video cassette recorder.

When the ring-like knob 60 is rotated to the right (in the clockwise direction) from the position for "Still Picture Replay" wherein the ring-like knob 60 is maintained in the neutral position, the elastic slide contact 61 held on the bottom surface of the ring-like knob 60 will be sliding on the circular arc-shaped fixed contact 53 and the position where both of the contacts are in touch with each other will be changed.

As a result, the output signal to the terminal block 55 is changed and the replay speed can be changed.

At that time, the ring-like knob 60 is rotated while one of the ends 63B of the spiral spring 63 is hooked by the extruded step 62A, or 62B created on the bottom surface of the ring-like knob 60, and the main coiling portion 63A of the spring coil 63 contracts against the elastic force exerted. Upon removal of the force exerted on the ring-like knob 60, the ring-like knob 60 will be restored to its original neutral position, e.g., "Still Picture Replay" position, due to the elastic force of the main coiling portion 63A of the spiral spring 63.

Although an example of using circular arc-shaped contacts 53 and a slide contact 61 has been illustrated in Embodiment 3 as a preferred means of detecting the rotational angle of the ring-like knob 60, other means of detection can also be used.

For instance, a continuous ring-like resistance film formed of an electric resistive material can be used instead of the circular arc-shaped contacts 53 and by sliding a slide contact on said resistance film the rotational angle of a ring-like knob can be detected from the changes in electric resistance.

Also, it is possible to use a detection means wherein a magnetic film recorded with a magnetic signal pattern is placed on the bottom surface of a ring-like knob and magnetic signals are detected by a magnetic head installed on a base to detect the rotational angle of the knob.

Further, it is also possible to use a rotational angle detection means known in the art as an optional encoder, wherein a light emitting device, a slit serving as a window, and a light receiving device are assembled together.

According to the present invention, a wide range of variations, changes and modifications can be made to the exemplary embodiments described above.

For example, although a switch element of a dome-shaped movable contact type was described in the foregoing exemplary embodiments, a push element which is actuated by an up and down, i.e., vertical movement of an associated knob can be used instead.

Additionally, in place of a base which is molded integrally with supports and other elements described above, a printed wiring board or a die-cast base can be used.

Furthermore, the spiral spring used as the return force means in one of the embodiments described above can be replaced by a plate spring or other suitable elastic materials, such as rubber, sponge or the like.

Although, in the second preferred embodiment of the invention, discussed above, the second push button illustrated therein is of a rectangular or square shape, the second push button of any other shape, such as circular, may be used.

The embodiments described above provide a number of significant advantages. The combination push switch device, such as that illustrated in FIGS. 1–7, provides a convenient and easy means of operating a plurality of switch elements independently of each other with a single push button. Such switch elements are operated independently due to the seesaw-like motion of the push button, while the operation of the other switch elements is effectively prevented by the features described above. Such a construction of the device enables the manufacturer to substantially reduce the number of components used in its assembly as compared to similar prior art devices. This, of course, also simplifies and reduces the cost of the assembly of the device.

The seesaw-like motion of the push button is facilitated by the coupling of the linkage means of the base and the linkage means of the push button. The couplings provide fulcra points at least two places of the device for a stabilized motion of the push button. Thus, even with the activation of one of the switch elements, it is possible to effectively keep the other switch elements open and therefore non-active. This provides an effective means of preventing inadvertent and/or erroneous activation of one of the switch elements which is not intended to be activated.

The extremely compact construction of the switch elements, combined with the use of a single push button, results in a substantial reduction of thickness of the entire combination push switch device. The assembly of the combination push switch device is substantially simplified by the ability to form multiple switch elements at the same time on the base.

Furthermore, the construction of the linkage means of the base and the push button comprising a support provided with a slip preventive means, such a pawl, and the fabrication of the supports or rods of the base or of the push button, in the most preferred embodiment, from elastic material, facilitates the coupling of the linkage means of the base and of the push button with each other. Such a coupling is accomplished by simply pressing the push button down towards the base, which also simplifies the final assembly of the device.

The thickness of the entire combination push switch device is furthermore reduced by the feature of having the linkage means placed in appropriate positions, such that the fulcra of the seesaw motion are located inside the switch elements. This eliminates a possible erroneous operation of the other switch elements even if the gaps between the switch elements and the push members are narrow. This further reduces the thickness of the entire combination push switch device.

Furthermore, the appropriate sizing of the gap between the push members and the switch elements also prevents or eliminates the possibility of erroneous, unintended operation of a switch element which is not intended to be activated.

Additionally, the absence of a linkage means in the central portion of the push button makes it possible to provide an opening in the push button, and the addition of an individual, second push button which can be placed in the central portion of that push button. This provides additional flexibility for the function of the combination push switch device since the second push button can now operate an additional switch element.

The provision of the rotational angle detecting means in one of the preferred embodiments described above provides an additional measure of flexibility to the device. Such an embodiment does not appreciably increase the thickness of the combination push switch device, yet it provides an additional enhanced function therefor, namely the possibility of providing an encoding function, such as a variable speed control for video cassette recorders.

It is therefore intended that the foregoing description of the invention be regarded as illustrative rather than limiting and that it be understood that it is the following claims, including all equivalents thereof, which are intended to define the scope of the invention.

We claim:

1. A multiple switch device comprising:

a base which comprises at least two switch units and linkage means placed in at least two positions on said base;

a push button having push members at each respective position opposite to each of said switch units and linkage means at each respective position opposite to each of the linkage means of said base; and a return means which forces said push button to return to its original position upon releasing a depress force from said push button;

said base and said push button assembled together through a coupling between said linkage means of the base and said linkage means of the push button, so as to allow a vertical movement of said push button, and said linkage means of the base and of the push button are arranged so as to satisfy a formula of $h \leqq k$, where k is the distance between the center of said push button and each of said push members and h is the distance between the center of said push button and fulcrum of a seesaw motion of the push button measured along the line connecting the center of said push button and each of said push members.

2. The multiple switch device of claim 1, wherein each of said switch units comprises a fixed contact formed on the upper surface of the base, a movable contact arranged on top of and spaced from the fixed contact, and an adhesive insulating film for maintaining the movable contact on top of the fixed contact.

3. The multiple switch device of claim 2, wherein said movable contact is dome-shaped.

4. The multiple switch device of claim 1, wherein the linkage means of said base comprises a first support and the linkage means of said push button comprises a second support, each of said first and second supports having a pawl on the tip thereof to prevent slipping of the linkage means of said base from the linkage means of said push button.

5. The multiple switch device of claim 4, wherein the first and second supports are formed of an elastic material.

6. The multiple switch device of claim 1, wherein said switch units and said push members are arranged respectively at four positions which are located at an equal distance from the origin of a first rectangular coordinate axis, and said linkage means of the base and the linkage means of the push button are arranged respectively at four positions located at an equal distance from the origin of a second rectangular coordinate axis which is rotated from said first rectangular coordinate axis by 45 degrees.

7. The multiple switch device of claim 1, which additionally comprises:

a second push button, which is inserted in an opening provided in the substantially central portion of said push button and which is movable independently from said push button in the vertical direction, and a separate switch units arranged on said base at a position opposite to said central push button.

8. The multiple switch device of claim 1, wherein each of said switch units comprises a fixed contact formed on the upper surface of the base, a dome-shaped movable contact arranged on top of and spaced from the fixed contact, and an adhesive insulating film covering the dome-shaped movable contact and fixing a periphery of the dome-shaped movable contact on the base, said return means comprises a spring disposed at a central position of the push button between the push button and the base, and a gap space is provided between a tip of each of said push members and a top of the adhesive insulating film positioned on top of the dome-shaped movable contact.

9. A multiple switch device comprising:

a base which comprises at least two switch units and a linkage means placed in at least two positions on said base;

a push button comprising push members at each respective position opposite to each of said switch units and a linkage means at each respective position opposite to each of the linkage means of said base;

a return means which forces said push button to return to its original position upon releasing a depress force from said push button;

a ring-like knob arranged outside the circumference of said push button, said ring-like knob provided with a knob-placed linkage means;

a linkage means for the knob arranged on said base at positions opposite to said knob-placed linkage means;

a rotational angle detecting means for detecting rotational angles of said ring-like knob; and a rotational return means for returning said ring-like knob to the original position thereof upon releasing a rotational operation;

said base and said push button assembled together through a coupling between said linkage means of the base and said linkage means of the push button, so as to allow a vertical movement of said push button, and said base and said ring-like knob assembled together through a coupling between said linkage means for the knob on the base and said knob-placed linkage means to allow a rotational movement of said ring-like knob.

10. The multiple switch device of claim 9, wherein said linkage means for the knob on the base is comprised of supports provided with pawls on the tips thereof to prevent slipping of said linkage means for the knob on the base and said knob-placed linkage means.

11. The combination push switch device of claim 9, wherein said rotational angle detecting means comprises a slide contact created on the bottom surface of said ring-like knob and circular arc-shaped contacts formed on said base at positions opposite to said slide contact.

12. The multiple switch device of claim 9, wherein each of said switch units comprises a fixed contact formed on the upper surface of the base, a dome-shaped movable contact arranged on top of and spaced from the fixed contact, and an adhesive insulating film covering the dome-shaped movable contact and fixing a periphery of the dome-shaped movable contact on the base, said return means comprises a spring disposed at a central position of the push button between the push button and the base, and a gap space is provided between a tip of each of said push members and a top of the adhesive insulating film positioned on top of the dome-shaped movable contact.

* * * * *

UNITED STATES PATENT AND TRADEMARK OFFICE

CERTIFICATE OF CORRECTION

PATENT NO. : 5,430,262

DATED : July 4, 1995

INVENTOR(S) : Matsui et al.

It is certified that error appears in the above-indentified patent and that said Letters Patent is hereby corrected as shown below:

Column 14, line 37, delete "combination push", and insert ----multiple--.

Signed and Sealed this

Ninth Day of September, 1997

*Attest:*

*Attesting Officer*

BRUCE LEHMAN

*Commissioner of Patents and Trademarks*